United States Patent [19]

Maier et al.

[11] 4,141,683

[45] Feb. 27, 1979

[54] PROCESS FOR THE DYEING OF WOOL

[75] Inventors: Hans-Peter Maier, Sulzbach am Taunus; Harpal Singh, Frankfurt am Main, both of Fed. Rep. of Germany

[73] Assignee: Hoechst Aktiengesellschaft, Frankfurt am Main, Fed. Rep. of Germany

[21] Appl. No.: 823,156

[22] Filed: Aug. 9, 1977

[30] Foreign Application Priority Data

Aug. 11, 1976 [DE] Fed. Rep. of Germany ..... 2635990

[51] Int. Cl.[2] ..... D06P 3/82; C09B 45/00

[52] U.S. Cl. ..... 8/21 R; 8/21 B; 8/22; 8/42 R; 8/42 B; 8/43; 8/85 R

[58] Field of Search ..... 8/21 R, 21 B, 43, 85 R, 8/22

[56] References Cited

U.S. PATENT DOCUMENTS 4,063,877 12/1977 Elliot et al. ..... 8/1 A

FOREIGN PATENT DOCUMENTS 607179 8/1961 Belgium.
1287558 1/1969 Fed. Rep. of Germany.

OTHER PUBLICATIONS

Lewis, D. M. and Seltzer, I., J. Soc. Dyers and Colourists, 1968, 84, pp. 501–507.

*Primary Examiner*—A. Lionel Clingman
*Attorney, Agent, or Firm*—Curtis, Morris & Safford

[57] ABSTRACT

Semi-continuous process for dyeing of flat woolen textile articles with 1:2 or 1:1 metal complex dyestuffs, by padding the textile material with an aqueous liquor containing the dissolved dyestuffs and of from 80 to 120 g/l of dissolved urea, at a temperature of from 60 to 80° C. and batching it up without intermediate drying, optionally with further heating, and allowing it to dwell in this state at a temperature of from 75 to 85° C. for a period of from 4 to 14 hours.

3 Claims, No Drawings

PROCESS FOR THE DYEING OF WOOL

The technical information paper D 1293 published by ICI discloses a process for the dyeing of wool by a pad-cold-dwell method using reactive dyestuffs, according to the recommendations of the IWS (International Wool Secretariat). Furthermore, metal complex dyestuffs are also used in the pad-cold-dwell process for dyeing wool, according to P.D. Report No. 136, entitled "Further Development of the Pad-Batch-Process" which has been published in April 1971 by this Secretariat.

In said process the dyestuff fixation on the wool fibers is made possible by the addition of urea to the padding liquor at a rate of 300 g/l. The so-called "cold-dwell process" which has been reported in detail in the journal "Textilveredlung" 7 (1972) No. 1, pages 24 to 27 and been disclosed in German Auslegeschrift No. 1,287,558 is based on a similar dyeing technique.

This kind of dyeing wool is generally considered to be a novel, semi-continuous and fiber-protecting method. Hitherto, however, this process has not been used in practice on a large scale. The main reason therefore certainly resides in the fact that the exploitation of the dyes and correspondingly the color yield of the dyeings is not satisfactory. Moreover a tendering of the woollen material, inspite of the cold-dwelling procedure, cannot be excluded since extremely high amounts of urea must be used.

It has now been found that flat textile articles made of wool or their mixtures with synthetic fibers can be dyed semi-continuously by a pad-batch process with 1:2 or 1:1 metal complex dyestuffs very deep shades, by padding the goods with an aqueous liquor containing the dissolved dyestuffs and of from 80 to 120 g/l of dissolved urea, at a temperature of from 60° to 80° C., batching them up without intermediate drying, optionally while further heating them, and allowing them to dwell in this state at a temperature of from 75° to 85° C. for a period of from 4 to 14 hours.

In the process of the invention the pH of the padding liquor is adjusted to a value ranging from 5 to 6.5 by the addition of acetic acid and the liquor is then employed for padding. The padding liquor may further contain auxiliaries, which assist a uniform wetting of the textile material made of wool or prevent the so-called frosting effect on the woollen fibers. These auxiliaries, however, do not exert any influence on the dyestuff fixation. Said fixation is rendered possible only be the addition of urea and by adequate temperature or dwelling conditions. In this novel semi-continuous process the dyestuffs are fixed neither by steaming them or with the supply of another heat energy, but simply by allowing them to dwell at a temperature of from 75° to 85° C. The batched-up goods are advantageously slowly rotated during the dwelling process.

The color intensity to be attained on woollen material in the process of the invention is very high and nearly reaches that obtained by the exhaustion process. It must be taken into consideration that metal complex or reactive dyestuffs are nearly completely exhausted in the exhaustion process. In the novel process the dyestuff yield obtained amounts to about 80% of that obtained in the exhaustion process. The dyestuff yields obtained hitherto in pad-dwell processes range between about 10 and 20% of the complete yield; consequently, processes of this type according to the state of the art yielded only light to medium shades. In the process of the invention, extremely deep shades having good fastness properties can be obtained with a normal dyestuff feed, and moreover the dyeing technique is very easy technically and requires no considerable expenditure on apparatus.

Dyeings of such deep color intensity are obtained without using any of the conventional textile auxiliaries or additives, which are, for example, used in the process according to Belgian Pat. No. 607,179. The color intensity obtained is extremely surprising and was not to be expected at all by one skilled in the art. Moreover, the easy and economic dyeing method is remarkable. Finally there are used no levelling agents.

According to the process of the invention woollen material or textile material containing wool, in whatever state of processing, can be dyed very fast and deep shades, especially without any tendering of the fiber. For the feed rates of urea from 80 to 120 g/l a damaging of the fiber by urea cannot take place. The tendering of the woollen fiber which is caused at feed rates of urea of 300 g/l in the cold-dwell-process according to the state of the art, is clearly demonstrable: Urea is a more or less efficient solvent for all proteins, the dissolving effect of which is the higher the more the fiber properties of the woollen material have been detrimentally affected in a preceding treatment. Moreover, the complicated chemism involving a partial transformation of urea into isocyanate must be taken into consideration, as it has likewise a detrimental effect on the woollen fibers.

Suitable dyestuffs for the process of the invention are the relatively difficultly soluble 1:2 metal complex dyestuffs and 1:1 metal complex dyestuffs.

These dyestuffs include 1:2 chromium or cobalt complex compounds of azo dyes, especially monoazo dyes, i.e. complex compounds in which 2 molecules of an identical azo dyestuff or each time 1 molecule of two azo dyestuffs which are different from one another are linked in complex manner to one chromium or cobalt atom. The complex compound may contain, for example, a disazo dyestuff and a monoazo dyestuff or preferably two identical or different monoazo dyestuffs molecules. Further suitable metal complex dyestuffs are metallized azo dyestuffs which contain per molecule of dyestuff only one metal atom linked in complex manner (1:1 metal complex compounds), especially copper, chromium or cobalt. These azo dyes contain as metal complex forming groupings preferably o,o'-dihydroxyazo groupings.

Because of the high exploitation of the dyestuffs according to the process of the invention a feed rate of dyestuffs as low as 30 g/l on the average will be sufficient. In the known dyeing technique generally more than 30 g/l of metal complex dyestuff must be dissolved in order to yield deep shades. Such high amounts of dyestuffs, however, can be dissolved only with difficulty.

The dyestuff exploitation in the process of the invention is optimal. The color intensity is no more improved by doubling or tripling the quantity of urea. A feed rate of urea of 300 g/l to the padding liquor yields the same color intensity as a feed rate of urea of 100 g/l, provided that the novel dyeing method hereinbefore described is employed. The use of the lower quantity of urea, however, has the advantage that the wool is not tendered while the color intensity remains the same.

The process of the invention is suitably carried out with batching-up times of different length to assure an operation as economic as possible, i.e. a rapid operation.

Light shades require a period of from 4 to 6 hours, medium shades of from 6 to 8 hours and deep shades a period of from 8 to 14 hours. Navy blue shades require relatively long batching-up times. Principally batching-up times which surpass the above limits have no detrimental effect.

For insuring a uniform application, there is added a thickener.

The following examples illustrate the invention:

EXAMPLE 1

30 g of the 1:2 cobalt complex compound of the formula

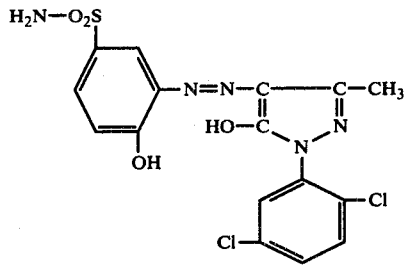

are thoroughly dissolved in about 400 ml of hot water. After cooling to about 70° C., 100 g of urea, in solid form, are added to the solution obtained and moreover 10 g of a completely etherified non-ionic product prepared from locust bean flour, in the form of a stock solution. After complete dissolution of these additives, the pH is adjusted to about 5 by means of acetic acid and the volume of the liquor is filled up to give 1000 ml.

A woollen fabric is padded with the liquor prepared, which has a temperature of about 65° C., with a liquor pick-up of 100% (calculated on the weight of the goods). The treated goods are thereafter batched-up on a roller. This batching-up process is carried out with the supply of heat to make the temperature of the batching-up roller increase to about 80° C. After a dwell time of 5 hours at this temperature the textile material is rinsed in conventional manner and washed out. There is obtained a deep yellow-orange dyeing.

The dyestuffs listed in the following table are dyed according to the same process:

| Example No. | quantity | dyestuff | padding temp. | batching-up temp. | batching-up time | shade of the dyeing |
|---|---|---|---|---|---|---|
| 2 | 25 g/l | 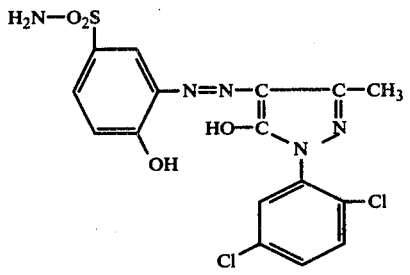 1:2-chromium complex compound | 60° C | 77° C | 6 hours | orange |
| 3 | 32 g/l | 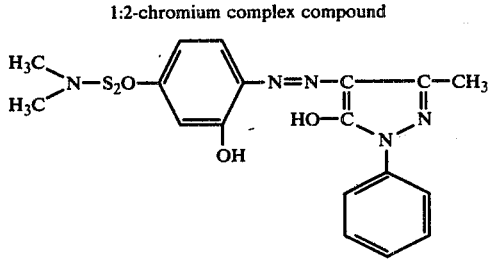 1:2-chromium complex compound | 80° C | 82° C | 4 hours | scarlet |
| 4 | 28 g/l | 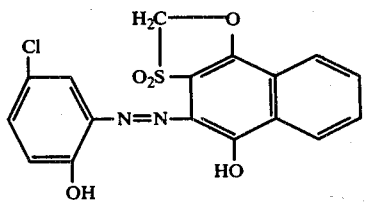 1:2-chromium complex compound | 65° C | 83° C | 7 hours | blue |

-continued

The dyestuffs listed in the following table are dyed according to the same process:

| Example No. | quantity | dyestuff | padding temp. | batching-up temp. | batching-up time | shade of the dyeing |
|---|---|---|---|---|---|---|
| 5 | 35 g/l | 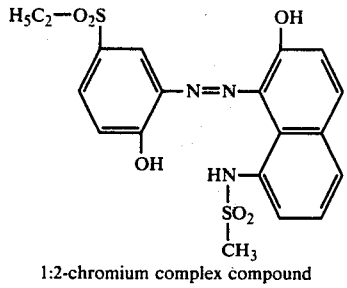 1:2-chromium complex compound | 70° C | 80° C | 10 hours | anthracite |
| 6 | 30 g/l | 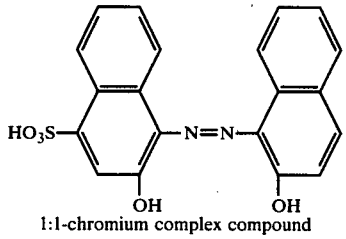 1:1-chromium complex compound | 75° C | 85° C | 9 hours | blue |
| 7 | 27 g/l | mixture consisting of 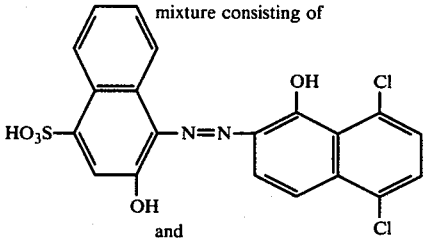 and 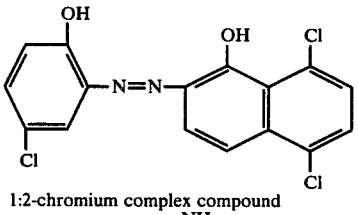 1:2-chromium complex compound | 60° C | 81° C | 11 hours | navy blue |
| 8 | 30 g/l | 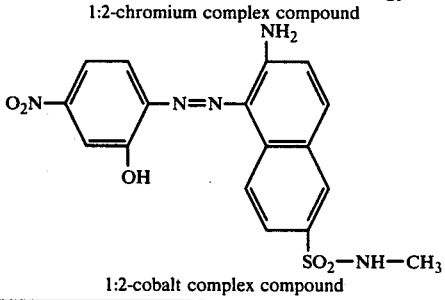 1:2-cobalt complex compound | 80° C | 79° C | 8 hours | blue |

We claim:

1. In a process for the dyeing of flat textile articles made of wool or mixtures thereof with synthetic fibres by means of 1:2 or 1:1 metal complex dyestuffs in the presence of a hydrotropic substance, and fixation of the dyestuffs by means of a dwelling operation, the improvement which comprises: padding a web of said textile material with an aqueous liquor containing a solution of at least one of said dyestuffs together with 80 to 120 g/l of dissolved urea at a temperature in the range of from 60° C. to 80° C.; batching-up the padded material without intermediate drying; and allowing the batched-up material to dwell at a temperature in the range of from 75° to 85° C. for a period of from 4 to 14 hours.

2. A process as claimed in claim 1, wherein the batched-up material is allowed to rotate slowly during the dwelling process.

3. A process as claimed in claim 1, wherein the batched-up goods are allowed to dwell for a period of from 4 to 6 hours for light shades, of from 6 to 8 hours, for medium shades and of from 8 to 14 hours for deep shades.

* * * * *